US005906321A

United States Patent [19]

Martin

[11] Patent Number: 5,906,321

[45] **Date of Patent: *May 25, 1999**

[54] NON-FERROUS METALS CLEANING SYSTEM

[75] Inventor: Ronald T. Martin, Portland, Tenn.

[73] Assignee: DUOS Engineering (USA), Inc., Jacksonville, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/807,292

[22] Filed: Feb. 27, 1997

[51] Int. Cl.[6] ..... B02C 17/02

[52] U.S. Cl. ..... 241/41; 241/74; 241/284; 241/299

[58] Field of Search ..... 241/41, 42, DIG. 10, 241/74, 24.11, 299, 284

[56] References Cited

U.S. PATENT DOCUMENTS

| | | | |
|---|---|---|---|
| 2,050,458 | 8/1936 | Overstrud et al. | 241/41 |
| 2,948,481 | 8/1960 | Daman | 241/41 |
| 4,995,561 | 2/1991 | Yukimi | 241/DIG. 10 |
| 5,016,827 | 5/1991 | Didion | 241/DIG. 10 |
| 5,312,051 | 5/1994 | Preisser | 241/41 |
| 5,540,395 | 7/1996 | Branscome | 241/41 |

*Primary Examiner*—Mark Rosenbaum
*Attorney, Agent, or Firm*—Arthur G. Yeager

[57] ABSTRACT

A cleaning system for non-ferrous metals for the removal of ash residue and dirt from metals derived from a municipal waste combustor includes an infeed chute for receiving the dirty metals and water from a clean water source. The water and metals are combined in a rotating tumbler for removal of the ash and dirt which is directed to a holding tank. The clean metal is engaged by a rotating upwardly angled drum that includes an internal helix. The metals are moved by the helix to an outlet and pass through a second spray of downwardly directed clean water for further cleaning of the metal. Motor-driven idlers and associated bearings provide for rotation and positioning of the apparatus. A water pump has an inlet from the holding tank and is used to maintain proper level control. An agitation pump prevents the collected ash and debris from settling in the tank.

15 Claims, 2 Drawing Sheets

NON-FERROUS METALS CLEANING SYSTEM

CROSS REFERENCE TO RELATED APPLICATION

This application is related to an application entitled "AN IMPROVED PROCESS FOR PROCESSING ASH", Ser. No. 08/686,765, filed Jul. 26, 1996.

BACKGROUND OF THE INVENTION

1. Field of the Invention

The present invention relates to methods and apparatus for the cleaning of non-ferrous metals and particularly for the cleaning of such metals extracted from the ash output stream of a municipal waste combustor (MWC).

2. Prior Art

Cleaning of non-ferrous metals is known to the prior art and frequently involves the use of expensive chemical technology that presents serious issues of environmental control that will limit the usefulness and applicability of such an approach on the large scale contemplated in MWC ash recycling. Other approaches such as impact hammermills are also limited in their usefulness because of expense and the irregular shape of the metals that are to be cleaned. Furthermore, what is desired is a process for large scale continuous cleansing. None of the systems or methods of the prior art are satisfactory for ash recycling systems.

SUMMARY OF THE INVENTION

In one aspect of the invention there is provided a method of cleaning dirty non-ferrous metals derived from the ash stream output from a municipal waste combustor comprising the sequential steps of: mixing the dirty non-ferrous metals with clean water to separate debris removed from the metals during mixing thereof; rotating the mixture in a tumbling manner to provide for impact cleaning of the metals to remove additional debris therefrom; separating the debris from the clean metals; and collecting the clean metals. Other aspects of the invention include the steps of: spraying the metals collected with clean water for further debris removal; rotating the collected metals while helically moving the metals generally horizontally for collection; spraying the metals during movement of the metals to provide for further cleaning of the metals; removing the water added to clean the metals; and spraying water on the metals in a direction generally opposite to the horizontal movement thereof. directing the collected metals upwardly and horizontally to facilitate separation of the metals from the debris and water. moving the metals upwardly to provide that the collection of metals is accomplished at a position higher than the rotating of the metals to provide for the removal of the water mixed with the metals; and removing the water with the debris and reclaiming the water after separation from the debris.

Another aspect of the present invention includes a system for cleaning of dirty non-ferrous metals derived from an ash stream output from a municipal waste combustor comprising a tumbler means for imparting rotary movement to metals and water being fed into the tumbler means, drain means for removing water and debris separated from the metals from the tumbler means, mounting means for rotatably mounting the tumbler means, and drive means connected to the tumbler means for rotating the tumbler means. The tumbler means includes a cylindrical member having a body, the body including an inner surface for defining an interior space and an input and output passageway in the body for directing metals respectively into and out of the member, the member including a plurality of spaced drain passageways remote from the said input and output passageways formed in the body for removing water and debris removed from metals from the interior space. The member includes spaced blade members affixed to the inner surface and extending laterally inwardly for engaging and imparting rotary movement to metals and water passing into placed in the member. The member includes an elongate hollow cylindrical drum having an inlet and an outlet, the drum inlet being connected to said output passageway of the tumbler means for receiving metals from the tumbler means, said mounting means rotatably mounting the drum, the drum having an inner surface, engagement means attached to the drum inner surface for engaging metals received in the drum. There is also a water spraying means for spraying water into the drum. The engagement means includes a helical thread for movement of metals from the inlet of the drum to the outlet of the drum. The mounting means includes frame means for mounting the drum to locate the outlet of the drum vertically higher than the inlet to permit gravity drainage of debris and water from metals within the drum.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT INTRODUCTION

The non-ferrous cleaner according to the present invention was developed to remove ash residue and dirt from non-ferrous metals extracted from Municipal Waste Combustor (MWC) by cleaning these metals, the task of hand-picking brass, copper and coins from the predominately aluminum stream becomes quick and easy while also increasing the market value of the separated metals to the secondary market. The present cleaner system can be used as a component in an ash recycling plant as discussed in the cross-referenced application.

OPERATION

A stream of dirty non-ferrous metals is directed to the infeed chute. Also injected into the infeed chute is process water pumped from the cleaning water spray system located at the facility. The first stage of the cleaning process is accomplished in the washer by providing a tumbling action to the metals and process water. This tumbling action removes essentially all of the ash and dirt that has adhered to the metals. The water and ash residue is discharged through screen covered drain holes in the back of the washer into a holding tank positioned below the washer.

When the level of recovered metals increases in the washer, an extension of a helix inside the rotating drum scoops metals from within the washer. As the scooped metals are moved along the helix, a second spray from the cleaning water spray system helps to provide additional washing and rinsing action. The metals continue to be conveyed up the helix drum through the action of the rotating helix. The metal conveyance up the helix drum at an angle provides cleaning, tumbling and dewatering action. Water and ash residue flow down the helix drum into the washer and eventually into the tank. When the metals reach the discharge of the helix drum they are essentially free of ash and dirt. The metals are next conveyed to the next stages of the recycling process which includes a dewatering screen and a hand-picking station.

The rotation of the helix drum and washer is achieved by a drive motor mounted on a frame which is adjustable to keep frictional pressure on an idler roller located below the helix drum. Springs on the adjuster rods help keep constant pressure on the idler roller to compensate for any irregularities in wear. To keep the drum located horizontally, a thrust ring, which is part of the helix drum, is in contact with adjustable idler bearings.

The handling of fluids begins by the injection of water from the process plant water into the infeed chute and the discharge end of the helix drum. The water and ash residue cleaned from the metals exit at the rear of the washer through the screened drain holes and into the tank. As the water level increases in the tank, an agitation pump begins to circulate the accumulated water and ash residue within the tank. A float switch on a water discharge pump serves to keep the water level between a selectable range by pumping the tank water and ash residue to the plant process water system.

SYSTEM DESCRIPTION

Figure 1:
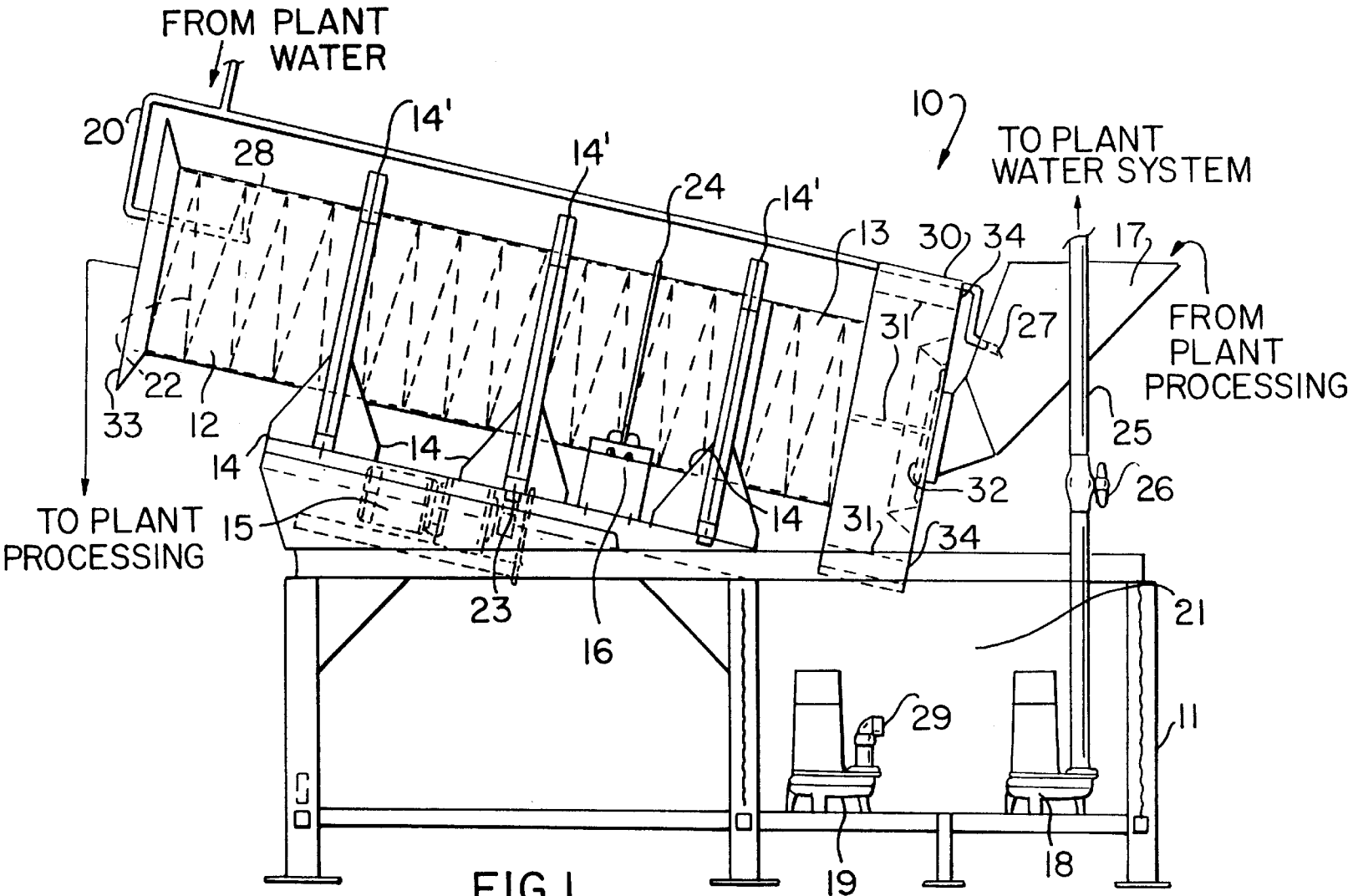
FIG. 1 is a side elevational diagram of the non-ferrous metal cleaner system in accord with the present invention.

With respect now to the drawings, the non-ferrous metal cleaning system in accord with the present invention is shown at numeral 10 in FIG. 1. A support frame 11 is conventional as understood in the art and is used to support helix drum 12 and the removable washer assembly 13 and associated apparatus. Drum idler frame 14 includes removable frame caps 14' to facilitate removal of drum 12 from frame 14 and assists in rotary motion of drum 12 via drive motor 15 and idler rollers 23. Adjustable idler bearings 16 work in conjunction with thrust ring 24 to limit horizontal motion of drum 12.

Figure 2:
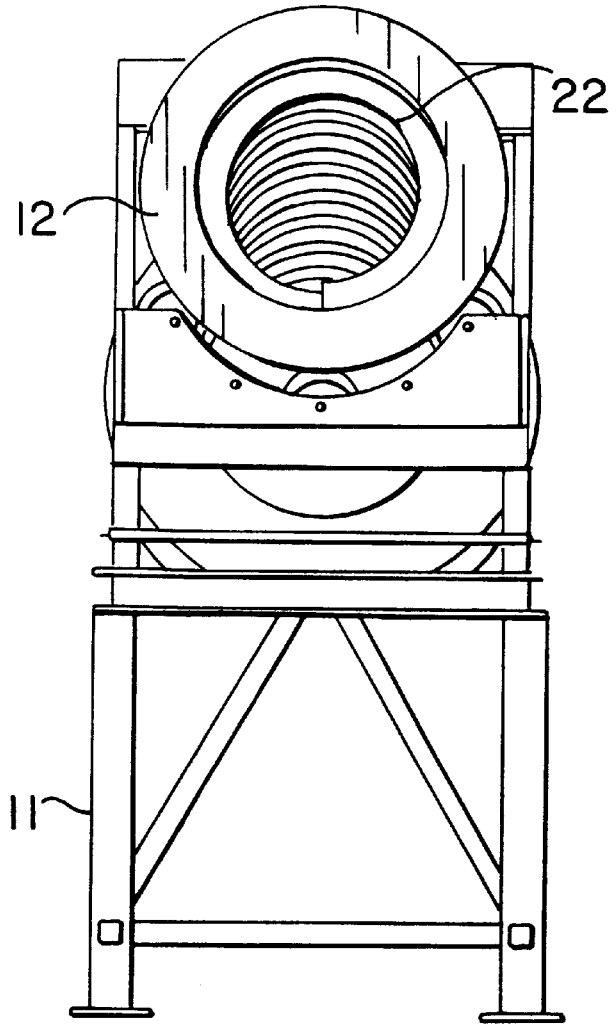
FIG. 2 is an end diagrammatic view of the apparatus of FIG. 1 showing the internal helix at the outlet of the cleaner system.

Removable infeed chute 17 receives clean water from the cleaning water spray system 20 which is connected to the recycling plant's water system (not shown). Water discharge pump 18 and tank agitator pump 19 will be discussed hereinbelow in regard to tank 21. The internal drum helix 22 is illustrated in FIG. 2 and also receives water from system 20. Other features used in maintenance such as a manual drain plug for tank 21 and an access door to washer assembly 13 are not shown but are well known in the art.

Figure 3:
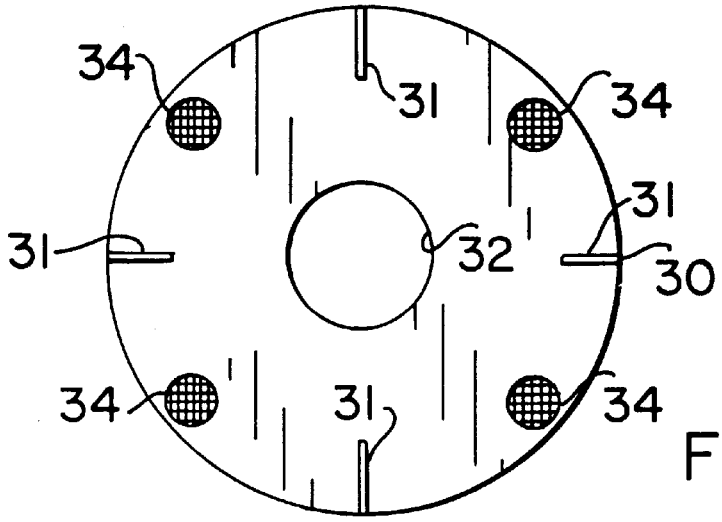
FIG. 3 is a pictorial drawing of the lower portion of the washer wall of the present invention.

The cleaning process works as follows. A stream of dirty non-ferrous metals that includes ash and other debris that has adhered to the metal is directed into tumbler inlet 32 via infeed chute 17 from the stream of recycled ash in the recycling facility. Clean water from the plant cleaning water spray system 20 is also directed into chute 17 via outlet spray head 27. The first stage of cleaning in the washer assembly 13 takes place in a tumbler 30 which includes blades 31 and is a removable part of assembly 13. The tumbler 30 is constructed as a cylindrical drum and provides a tumbling action that results in impact cleaning to remove ash, dirt, and other debris from the metals therein. Water and the accompanying ash and dirt is discharged through screen-covered drain holes 34 located in the rearward portion of the washer assembly 13. The drain holes 34 discharge water and debris downwardly into tank 21 that is located therebelow. (See FIG. 3.)

As the amount of non-ferrous metals in tumbler 30 increases the metals will come into contact with engagement means in the form of helix 22 at tumbler outlet 33. A rearward extension of the helix 22 will engage the metals which are then pushed upwardly and ultimately out of the drum 12 at outlet 33 and into the next stage of the recycling system. A second spray head 28 directs water from spray system 20 downwardly against the upwardly angled generally horizontal movement of the metals in drum 12. This movement provides for additional steps of tumbling, cleaning, and, because of the upward angle, which is about 10 degrees, dewatering of the metals. Residual ash and water will flow into tank 21 through drain holes 34.

The drive motor 15 is used to control the rotation of washer assembly 13. The idler frame 14 supports idler rollers 23. Thrust ring 24 and idler bearings 16 are used for proper rotation and horizontal positioning of the drum 12 as understood in the art.

Pump 18, which may be controlled by a level-operated float valve or similar water-level controllers, is used to discharge water from tank 21 to the plant water system via pipe 25 and shut off valve 26. Submersible agitation pump 19 has a discharge port 29 to keep the ash in circulation so that it can be pumped from the tank via pump 18 and may also include water-level based control. Pumps 18 and 19 may be of any conventional design.

The design of the present invention provides for continuous processing of dirty non-ferrous metals at the rate of 2000+ lbs. per hour derived from an ash stream and it does so in a relatively closed system without the expense or hazards of chemical cleaning and other technology of limited applicability.

While the invention has been described with respect to certain specific embodiments, it will be appreciated that any modifications and changes may be made by those skilled in the art without departing from the spirit of the invention. It is intended, therefore, by the appended claims to cover all such modification and changes as fall within the true spirit and scope of the invention.

What is claimed as new and what it is desired to secure by Letters Patent of the united states is:

1. A system for cleaning of dirty non-ferrous metals derived from an ash stream output from a municipal waste combustor comprising a tumbler means having an outlet passageway for imparting rotary movement to metals and water being fed into said tumbler means, drain means for removing water and debris separated from the metals from said tumbler means, mounting means for rotatably mounting said tumbler means, drive means connected to said tumbler means for rotating said tumbler means, an elongate hollow cylindrical drum having an inlet and an outlet, said drum inlet being connected to said outlet passageway of said tumbler means for receiving metals from said tumbler means, said mounting means rotatably mounting said drum, said drum having an inner surface, engagement means attached to said drum inner surface for engaging metals received in said drum, said engagement means including a helical thread for movement of metals from said inlet of said drum to said outlet of said drum, said helical thread extending substantially between said outlet passageway of said tumbler means and said outlet of said drum.

2. The system as defined in claim 1 wherein said tumbler means includes a cylindrical member having a body, said body including an inner surface for defining an interior space and an input and output passageway in said body for directing metals respectively into and out of said member, said member including a plurality of spaced drain passageways remote from said input and output passageways formed in said body for removing water and debris removed from metals from said interior space.

3. The system as defined in claim 2 wherein said member includes blade members affixed to said inner surface and extending laterally inwardly for engaging and imparting rotary movement to metals and water passing into said drum.

4. The system as defined in claim 1 further including water spraying means for spraying water into said drum.

5. The system as defined in claim 1 wherein said mounting means includes frame means for mounting said drum to locate said outlet of said drum vertically higher than said inlet to permit gravity drainage of debris and water from metals within said drum.

6. The system as defined in claim 5 further including water spraying means located adjacent said outlet of said drum for spraying water into said drum for further cleaning of metals therein.

7. A system for cleaning of dirty non-ferrous metals derived from an ash stream output from a municipal waste combustor comprising a tumbler means for imparting rotary movement to metals and water being fed into said tumbler means, drain means for removing water and debris separated from the metals from said tumbler means, mounting means for rotatably mounting said tumbler means, drive means connected to said tumbler means for rotating said tumbler means, an elongate hollow cylindrical drum having an inlet and an outlet, said drum inlet being connected to said output passageway of said tumbler means for receiving metals from said tumbler means, said mounting means rotatably mounting said drum, said drum having an inner surface, engagement means attached to said drum inner surface for engaging metals received in said drum, said engagement means including a helical thread for movement of metals from said inlet of said drum to said outlet of said drum, said mounting means including frame means for mounting said drum to locate said outlet of said drum vertically higher than said inlet to permit gravity drainage of debris and water from metals within said drum.

8. The system as defined in claim 7 further including water spraying means for spraying water into said drum.

9. The system as defined in claim 7 further including water spraying means located adjacent said outlet of said drum for spraying water into said drum for further cleaning of metals therein.

10. The system as defined in claim 7 wherein said tumbler means includes a cylindrical member having a body, said body including an inner surface for defining an interior space and an input and output passageway in said body for directing metals respectively into and out of said member, said member including a plurality of spaced drain passageways remote from said input and output passageways formed in said body for removing water and debris removed from metals from said interior space.

11. The system as defined in claim 7 wherein said drum includes blade members affixed to said inner surface and extending laterally inwardly for engaging and imparting rotary movement to metals and water passing into said drum.

12. A system for cleaning of dirty non-ferrous metals derived from ash stream output from a municipal waste combustor comprising an elongate hollow cylindrical washer assembly having a lower inlet portion and an upper outlet portion, said washer assembly having a tumbler means located at said inlet portion for imparting rotary motion to dirty metals fed therein, and a helical drum portion for receiving metals from said tumbler means and transporting metals to said upper outlet portion, first water spray means located adjacent said inlet portion for mixing water with dirty metals entering said tumbler means, second water spray means located in said outlet portion for spraying water on metals in said helical drum portion for washing debris from metals downwardly to said tumbler means, said tumbler means includes drainage means for removing water and debris from said tumbler means, mounting means for rotatably mounting said washer assembly, and drive means for rotating said washer assembly, said second water spray means being positioned to direct water in a direction generally opposite the direction of movement of metals in said helical drum portion.

13. The system as defined in claim 12 wherein said mounting means includes frame means for mounting said drum to locate said outlet of said drum vertically higher than said inlet to permit gravity drainage of debris and water from metals within said drum.

14. The system as defined in claim 12 wherein said mounting means includes frame means for mounting said drum to locate said outlet of said drum vertically higher than said inlet for gravity drainage of debris and water within said drum to pass from said drum into said tumbler means and to be discharged therefrom.

15. The system as defined in claim 12 wherein said tumbler means includes a drum having an inside surface and a plurality of spaced blade members extending laterally inwardly therefrom for imparting rotary movement to metals and water passing into said drum.

* * * * *